US009072928B2

(12) United States Patent
Reed et al.

(10) Patent No.: US 9,072,928 B2
(45) Date of Patent: Jul. 7, 2015

(54) EXERCISE APPARATUS AND METHODS FOR MAKING THE SAME

(71) Applicant: DICK'S SPORTING GOODS, INC., Coraopolis, PA (US)

(72) Inventors: Shawn Charles Reed, Mc Kees Rocks, PA (US); Michael Otterman, Mars, PA (US)

(73) Assignee: DICK'S SPORTING GOODS, INC., Coraopolis, PA (US)

( * ) Notice: Subject to any disclaimer, the term of this patent is extended or adjusted under 35 U.S.C. 154(b) by 187 days.

(21) Appl. No.: 13/759,423

(22) Filed: Feb. 5, 2013

(65) Prior Publication Data

US 2014/0221177 A1 Aug. 7, 2014

(51) Int. Cl.
*A63B 21/02* (2006.01)
*A63B 21/00* (2006.01)

(52) U.S. Cl.
CPC ..... *A63B 21/00043* (2013.01); *A63B 21/02* (2013.01)

(58) Field of Classification Search
CPC ..... A63B 21/0552; A63B 21/00061; A63B 21/0442; A63B 2208/0204; A63B 2071/024; A63B 2071/025; A63B 2071/02
USPC ..... 482/121–129
See application file for complete search history.

(56) References Cited

U.S. PATENT DOCUMENTS

| | | | | |
|---|---|---|---|---|
| 5,800,322 | A | 9/1998 | Block | |
| 7,628,743 | B1 * | 12/2009 | Flentye et al. | 482/126 |
| 7,794,374 | B1 * | 9/2010 | Park | 482/122 |
| 7,819,787 | B2 * | 10/2010 | Kassel | 482/122 |
| 8,075,461 | B2 * | 12/2011 | Terry et al. | 482/121 |
| 8,657,727 | B1 * | 2/2014 | Kassel et al. | 482/122 |

* cited by examiner

*Primary Examiner* — Stephen Crow
(74) *Attorney, Agent, or Firm* — Greenberg Traurig, LLP

(57) ABSTRACT

An exercise apparatus may include an elongated tube disposed between a pair of handles. The elongated tube may be stretchable and flexible, making the exercise apparatus ideal for use in resistance training, amongst other sports and activities. The elongated tube may be attached to each handle by a grommet, a gasket, and an insert. An end of the elongated tube may be threaded through the gasket and may receive the insert, which prevents the end of the elongated tube from retreating back through the gasket. The grommet may be arranged on the gasket and affixed to a strap defining a portion of the handle.

18 Claims, 5 Drawing Sheets

EXERCISE APPARATUS AND METHODS FOR MAKING THE SAME

FIELD OF THE DISCLOSURE

The present disclosure relates generally to exercise equipment that can be used, for example, for resistance training and other sports and activities and, more particularly, to exercise apparatus and methods for making exercise apparatus.

BACKGROUND OF RELATED ART

Exercise apparatus that can be used for resistance training typically include a stretchable, flexible, elongated tube disposed between a pair of handles. As part of resistance training, a user of an exercise apparatus clenches one or both of the handles and repeatedly pulls or stretches the elongated tube and then slowly releases the elongated tube, thereby building muscle strength and/or toning muscles.

One problem associated with these apparatus is that handles can break off from the elongated tube during use of the apparatus. Due to the nature of this type of exercise apparatus, if the handle breaks off during use, it can cause the elongated tube to snap back and possibly cause damage or injury. Oftentimes breakages occur because a metal component used to attach the handles to the elongated tube contacts the elongated tube and either initiates or exacerbates a tear in the elongated tube.

By way of example, U.S. Pat. No. 5,800,322, entitled "EXERCISE DEVICE AND METHOD FOR FORMING HANDLES OF THE DEVICE" and issued to Block ("the '322 Patent"), describes how an elongated stretch tube can be connected to a handle. Exercise devices that use the design described in the '322 Patent, however, may be subject to breaking because the grommet 42 can contact the elongated stretch tube 12 if the sleeve 12 and the end 24 of the elongated stretch tube 12 are pulled towards the hand grip 50. In other words, as the grommet 42 slides away from the sleeve 22 and the end 24 of the elongated stretch tube 12, the grommet 42 contacts the elongated stretch tube 12, which can initiate a tear in the tube 12.

Accordingly, in at least one example of the present disclosure, there is provided an exercise apparatus having a pair of handles that are secured to an elongated tube in a manner that may reduce or eliminate the likelihood that the handles will break off from the elongated tube at least partially because the grommet is protected from contact with the tube by an associated gasket. Still further, in at least one example of the present disclosure, there is provided a method for forming and securing such handles to the elongated tube.

DETAILED DESCRIPTION

Figure 1:
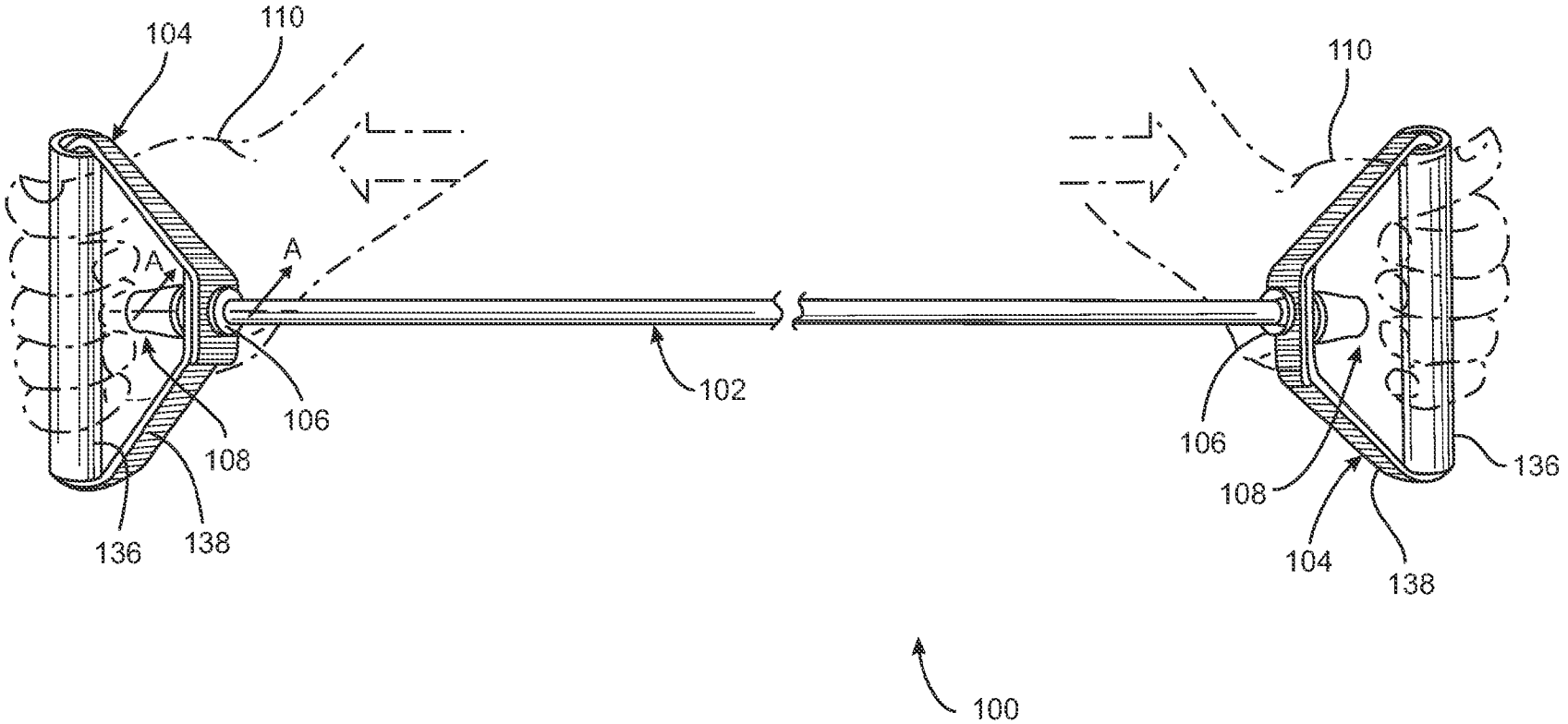
FIG. 1 is a perspective view of an exercise apparatus being used by both hands of a user, where arrows represent a manner of use of the apparatus.

The following description of example apparatus and methods is not intended to limit the scope of the description to the precise form or forms detailed herein. Rather, the following description is intended to be illustrative so that others may follow its teachings.

The following describes various example exercise apparatus and methods of forming the example apparatus for use in resistance training and other sports and activities. The examples described herein may generally include one or more handles attached to an elongated tube that is flexible, stretchable, and typically used for resistance training In at least one example, the elongated tube may have an inner channel that extends along a length or along a portion of the length of the elongated tube. A portion of the elongated tube near an open end of the elongated tube may be attached and/or otherwise secured to the handle through the use of a grommet, a protective gasket, and an insert, as described herein.

More specifically, in one disclosed example, the handle includes a strap with overlapping ends. In this example, a grommet is attached to a hole extending through the overlapping ends of the strap, securing each of the overlapping ends of the strap to one another. A gasket is arranged around the elongated tube and restrained within the grommet between the grommet and the tube. The gasket has one or more rims, channels, detents, etc. that restrict relative movement between the grommet and the gasket. For instance, in one example, the grommet is disposed between two rims of the gasket, which prevent the grommet from contacting the elongated tube, while in a second example, the gasket includes a single rim, which still generally prevents the grommet from contacting the elongated tube, but allows for easier assembly.

In particular, to assemble the example apparatus, the open end of the elongated tube is inserted through a hole in the gasket. The open end of the elongated tube is temporarily deformed so that a substantially rigid insert can be placed into the inner channel. To prevent the insert from passing through the hole in the gasket and/or grommet, the insert is larger than the hole in the gasket and/or otherwise shaped such that the insert cannot pass through the gasket. Once the insert is arranged adjacent to the gasket, the open end is prevented from retreating back through the gasket. Thus the handle, which is secured to the grommet, which is in turn secured to the gasket, is secured to the elongated tube because the open end of the elongated tube cannot retreat back through the gasket.

It will be appreciated by one of ordinary skill in the art that the grommet and the gasket may be formed of or at least coated with a rubberized, polymeric, nonmetallic, or other suitable material so as to prevent damage to the elongated tube. This choice of material may be particularly helpful where the gasket only includes one rim, which may allow the grommet to occasionally contact the elongated tube. However, in some examples, the strap of the handle may be formed to include two loops. A first loop may contain or provide a hand grip for a user, while a second loop may cooperate with the open end of the elongated tube to prevent the open end from moving with respect to the gasket. Thus, due to the second loop and at least one rim of the gasket, the grommet is prevented from moving along the gasket.

The present disclosure also provides a method of making the exercise apparatus. The method enables the handle or handles of the exercise apparatus to be formed and secured to the elongated tube readily and easily in a cost-efficient manner.

Referring now to FIG. 1, an example exercise apparatus 100 generally comprises an elongated tube 102 and a pair of handles 104, which define holes for receiving the elongated tube 102. In addition, the example exercise apparatus 100 includes a pair of inserts (such as the insert 132 of FIG. 2), a pair of gaskets 106, and a pair of grommets (such as the grommet 146 of FIG. 2) for securing the handles 104 to the elongated tube 102 adjacent respective open ends 108 of the elongated tube 102. Although FIG. 1 illustrates the exercise apparatus 100 as being used by both hands 110 of a user, the present disclosure contemplates a wide variety of applications for the exercise apparatus 100. For instance, one handle 104 of the exercise apparatus 100 could be mounted to a stationary object while a user clenches the other handle 104 during resistance training By way of further example, one handle 104 could be attached to a user's leg and the other handle 104 could be mounted to a stationary object or clenched with a hand. Likewise, two people could use the exercise apparatus 100. Still further, the exercise apparatus 100 could include a third or more handles as desired. One of the handles 104 could be mounted to a stationary object while the user clenches two handles 104 for resistance training The exercise apparatus 100 disclosed and shown, therefore, are merely examples.

Figure 2:
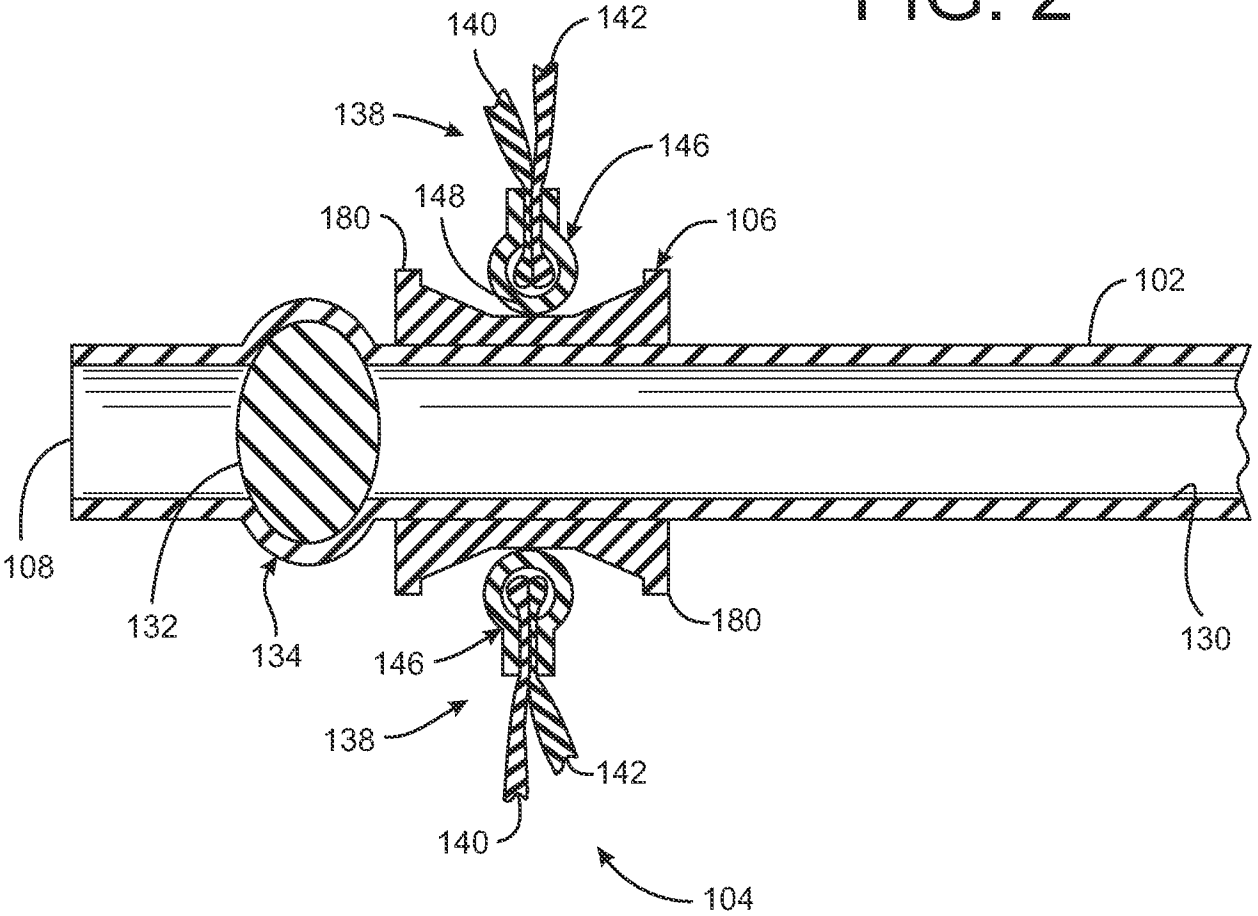
FIG. 2 is a cross-sectional view of an elongated tube attached to a handle, taken across line A-A in FIG. 1.
Figure 3:
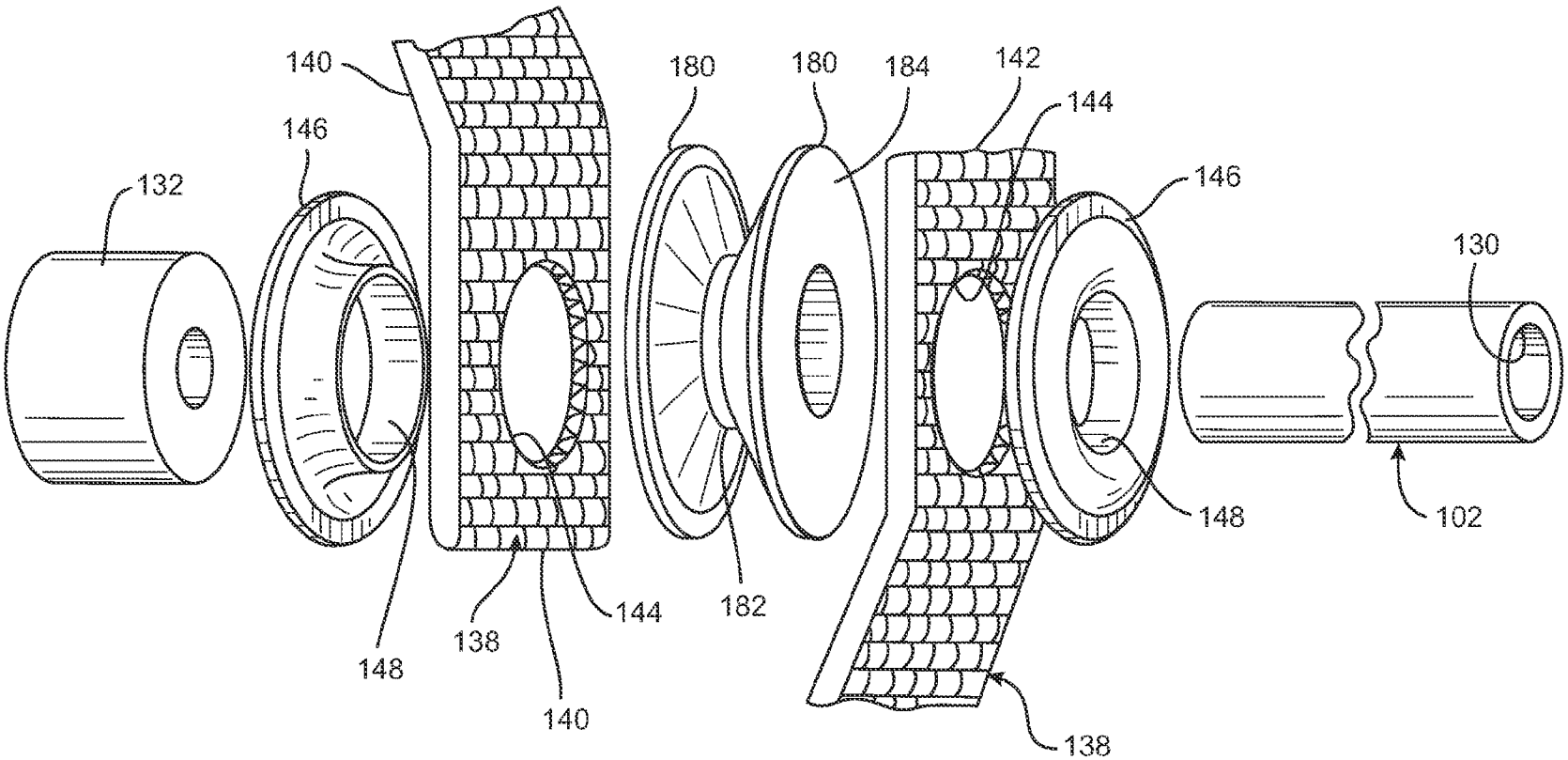
FIG. 3 is a broken view illustrating an insert, a gasket, and a grommet used to secure a handle to the elongated tube of FIG. 1.

In some examples, such as those shown in FIGS. 2-3 for instance, the elongated tube 102 is a flexible, stretchable, rubberized tube defining an inner channel 130. Although only a portion of one handle 104 is shown in and described with respect to FIGS. 2-3, a portion of a second handle may be similar or the same as the portion of the handle 104 shown in FIGS. 2-3. Moreover, it should be understood that in other examples the elongated tube 102 may be solid without the inner channel 130 and/or partially solid with a portion of the tube defining a channel 130. In still other examples, only a portion of the elongated tube 102 may be flexible and/or stretchable. Nonetheless, the inner channel 130 may extend completely or substantially along a length of the elongated tube 102.

An insert 132 may be received within the inner channel 130 and positioned adjacent to the open end 108 of the elongated tube 102. The insert 132 may be adapted to be received snugly within the elongated tube 102 adjacent the open end 108 of the elongated tube 102. The example insert 132 shown in FIG. 2 is elliptical or spherical, but the present disclosure contemplates inserts having a variety of shapes and sizes. For instance, the insert 132 shown in FIG. 3 is cylindrical with a hollow center. Further, the insert 132 may be sized to expand a segment 134 of the inner channel 130 by deforming or expanding the segment 134 of the elongated tube 102 disposed about the insert 132. In other words, a cross-section of the insert 132 may be larger than a diameter of the inner channel 130 in a neutral state (i.e., not deformed). One example purpose of the insert 132 is to prevent the handle 104 from disengaging from the elongated tube 102 by preventing the open end 108 from retreating back through the gasket 106. Still further, the outer surface of the insert 132 may be sufficiently provided with a roughness and/or adhesives such that once inserted into the channel 130, the insert 132 is substantially permanently mounted within the channel 130.

In some examples, the handle 104 comprises a hand grip 136, as shown in FIG. 1, in addition to a strap 138 formed of, for instance, nylon webbing, polypropylene material, or the like. With continued reference to FIGS. 2-3, the strap 138 may have two ends 140, 142 that can be brought together in an overlapping relationship to define a loop adapted to receive a hand or a foot of a user or any suitable stationary object. In addition or in the alternative, the user may clench the hand grip 136, which may be supported by the strap 138. The hand grip 136 may have the shape of a cylindrical tube and may be disposed about a portion of the strap 138. Further, the hand grip 136 may be constructed of any suitable rigid or flexible plastic or other material, such as foam, high density polyethylene, or a flexible polyvinyl chloride (PVC), for example. Moreover, as shown best in FIG. 3, a hole 144 (or holes) near the ends 140, 142 of the strap 138 extend through the area of overlap. The ends 140, 142 of the strap 138 may be fastened together in the area of overlap by a grommet 146 forming a grommet hole 148. Although not shown, a washer may be received in the grommet 146. In some examples, to protect the elongated tube 102 in the event that the grommet 146 were to contact the elongated tube 102, the grommet 146 may be formed of or at least coated with rubber or any other suitable material.

Figure 4:
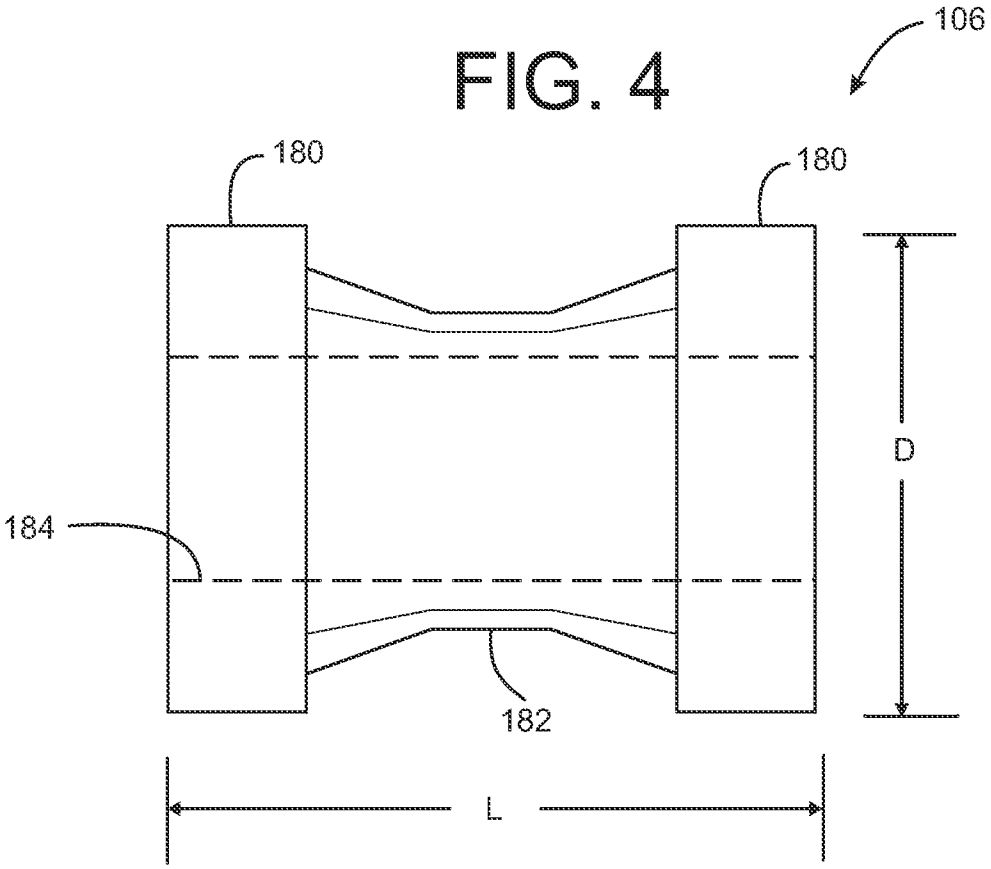
FIG. 4 is a side view of an example gasket used in securing the elongated tube to the handle.
Figure 5:
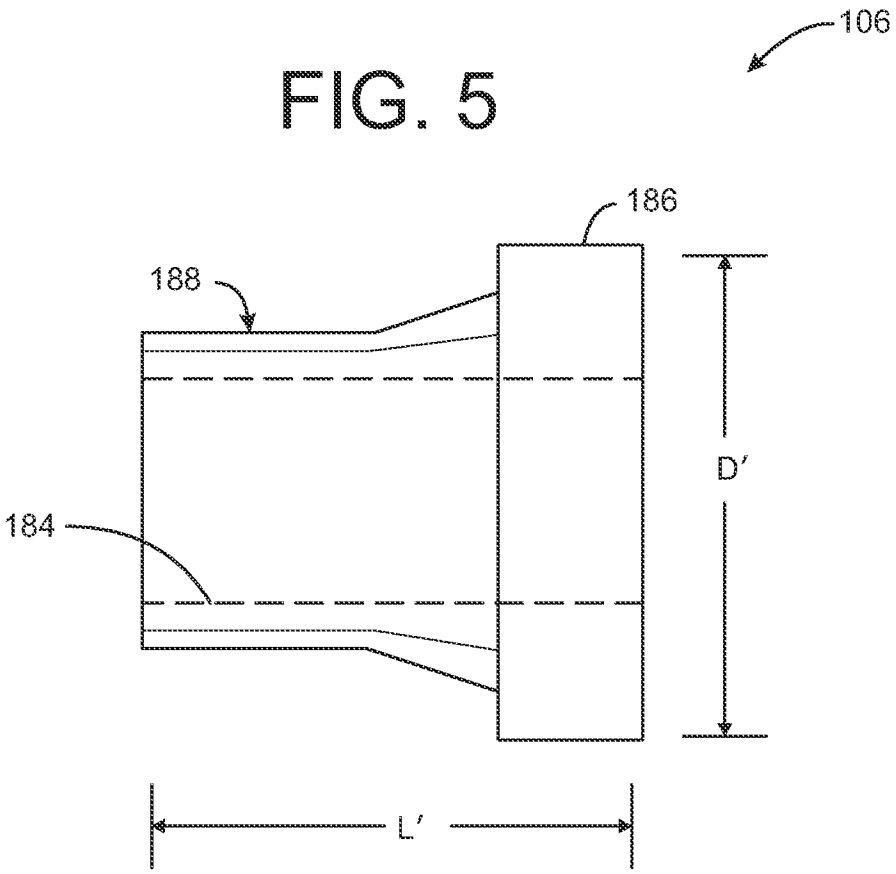
FIG. 5 is a side view of another example gasket used in securing the elongated tube to the handle.

In some examples, such as the example illustrated in the present Figures, the exercise apparatus 100 may further include the gasket 106 through which the elongated tube 102 passes. In particular, as shown in FIG. 2, the example gasket 106 supports and retains the grommet 146, which is disposed about the gasket 106 and secured to the hole 144 in the strap 138. In other words, the gasket 106 is disposed between the elongated tube 102 and the grommet 146 in this example. In the examples shown in FIGS. 2-4, the gasket 106 is symmetrical and is defined by rims 180, a midsection 182, a diameter D, a length L, and a hole 184 extending along the length L. Although the gasket 106 is shown to be cylindrical in FIGS. 2-5, the gasket 106 is not so limited. Likewise, although the gasket 106 is shown to be symmetric in FIGS. 2-4, the gasket 106 is not necessarily symmetric and may have a variety of alternative configurations, such as that shown in FIG. 5. For instance, the example gasket 106 shown in FIG. 5 has a rim 186, a body 188, a diameter D', and a length L'. The example gasket 106 of FIG. 5 may also have the hole 184 extending along its length L'.

Further, to prevent the gasket 106 from damaging and/or to reduce the risk of damaging the elongated tube 102, the gasket 106 may be formed of or at least coated with rubber, polymeric material, or any other suitable material. Further yet, the midsection 182 of the gasket may be sized to fit within the grommet hole 148. The grommet 146 may be retained on the gasket 106 particularly well in examples where the gasket 106 is symmetric and has two rims 180. In yet further examples not illustrated in the Figures, though, at least one of the two rims 180 is not disposed at an end of the gasket. Moreover, in some examples, the gasket 106 may have two rims 180 with unequal diameters.

Also, the hole 184 of the example gaskets 106 has a constant and/or substantially constant diameter. In some examples, the insert 132 will generally not occupy part of the hole 184 of the gasket 106. In addition, the diameter of the hole 184 of the gasket 106 may in some examples be substantially equal to or slightly less than an outer diameter of the elongated tube 102.

As disclosed above, the insert 132 may be configured in any manner suitable to expand a respective portion of the inner channel 130. In some examples, an outer diameter and/or cross-section of the example insert 132 is greater than a diameter of the inner channel 130, is greater than the diameter of the hole 184 in the gasket 106, and is greater than a diameter of the grommet hole 148. Thus when the handle 104 is pulled during use of the exercise apparatus 100, the insert 132 prevents the handle 104 from disengaging from the elongated tube 102 because the insert 132 prevents the gasket 106, the grommet 146, and hence the handle 104 from sliding towards the open end 108 of the elongated tube 102. In other words, the insert 132, the gasket 106, and the grommet 146 operate to restrict movement of the handle 104. Put still another way, the open end 108 of the elongated tube 102 is prevented from retreating back through the hole 184 in the gasket 106.

Those having ordinary skill in the art will appreciate that the disclosed exercise apparatus 100 is not limited to the examples described herein. For instance, the exercise apparatus 100 need not necessarily include the insert 132. Rather, the elongated tube 102 may be tied off in a knot, for example, or walls of the elongated tube 102 near the open end 108 may be significantly thicker so as to prevent that portion from retreating back through the hole 184 in the gasket 106. Likewise, the grommet 146 and the gasket 106 could be consolidated into one piece.

When one or both of the handles 104 are pulled by the user, the pulling forces of the handles 104 are exerted onto the elongated tube 102, thereby pulling the elongated tube 102 in opposite directions and stretching the elongated tube 102. Because the gasket 106 is located between the grommet 146 and the elongated tube 102, the gasket 106 protects the elongated tube 102 from direct contact with the grommet 146. Thus, as the elongated tube 102 is stretched back and forth, the elongated tube 102 rubs against the gasket 106 rather than the grommet 146. Therefore, the gasket 106 prevents or reduces the likelihood of breakage and extends the life of the elongated tube 102.

As disclosed above, the elongated tube 102, the insert 132, the gasket 106, and the grommet 146 may be constructed of any suitable material, such as rubber or the like. In one example, the elongated tube 102 and the gasket 106 may be constructed of the same material because the elongated tube 102 may rub against the gasket 106 as it is stretched back and forth. By making the elongated tube 102 and the gasket 106 of the same material, the life of the elongated tube 102 may be extended. Likewise, the insert 132 may also be constructed of the same material as the elongated tube 102. However, the insert 132 may be substantially thicker than the elongated tube 102 and the gasket 106 so as to provide increased rigidity. What's more, the rubberized, polymeric, nonmetallic, or other suitable material of the grommet 146 may be particularly advantageous in examples where an asymmetric gasket 106 is used. In these examples, the grommet 146 may occasionally slide off the gasket 106 and contact the elongated tube 102. The rubberized, polymeric, nonmetallic, or other suitable material, though, is gentile on the elongated tube 102 and prevents any damage.

In still another example, both sides of the strap 138 of the handle 104 may be further secured to one another near the open end 108 of the elongated tube 102. Thus, the handle 104 may form two loops rather than one—a first loop for the hand grip 136 and a second loop about the open end 108 of the elongated tube 102. By forming the second loop around the open end 108 of the elongated tube 102, the second loop acts to limit movement between the grommet 146, which is secured to the ends 140, 142 of the strap 138, and the gasket 106. Limiting movement between the grommet 146 and the gasket 106 may be particularly advantageous where the gasket 106 only includes one rim 180, because the grommet 146 would otherwise be able to slide off of the gasket 106 and onto the elongated tube 102, at least to some degree. However, with the second loop cooperating with the open end 108 of the elongated tube 102, the number of instances where the grommet 146 slides off of the gasket 106 and contacts the elongated tube 102 is at least reduced, if not eliminated. Thus, gaskets having one rim may be just as advantageous as gaskets having two rims. And further, in some examples, the assembly process for gaskets having one rim may be quicker than the assembly process for gaskets having two rims.

In one example, each handle 104 of the exercise apparatus 100 is assembled by a method that includes one or more of the following steps: inserting one of the ends 140 of the strap 138 through the hand grip 136; joining both ends 140, 142 of the strap 138 in an overlapping arrangement; forming the hole 144 in the ends 140, 142 of the strap 138 at the overlapping arrangement; setting or securing the grommet 146 on the ends of the strap 138 at the hole 144; arranging the grommet 146 about the gasket 106; inserting one of the ends of the elongated tube 102 through the hole 184 in the gasket 106; expanding the segment 134 of the elongated tube 102 by deforming the open end 108 of the elongated tube 102; and inserting the insert 132 into the open end 108 of the elongated tube 102. One having ordinary skill will appreciate that these steps can be accomplished in any suitable manner, and that these steps can be repeated to form the other handle 104.

In one example, the step of joining the two ends 140, 142 of the strap 138 together to form a loop may include stitching or otherwise bonding the material together. Moreover, the step of forming the hole 144 in the ends 140, 142 of the strap 138 can be accomplished in any suitable manner, such as, for example, by using a soldering iron. Further, the step of setting the grommet 146 may be achieved by any suitable means such as, for example, through the use of a grommet setting device. As an alternative or in addition, the step of forming the hole 144 or of setting the grommet 146 may secure the two ends 140, 142 of the strap 138 together.

The step of expanding the segment 134 of the inner channel 130 of the elongated tube 102 by deforming or expanding the open end 108 of the elongated tube 102 may likewise be accomplished in a number of ways. For example, it can be accomplished by inserting a plurality of pins into the inner channel 130 at the open end 108 of the elongated tube 102. The spacing between the pins may be increased, and after the insert 132 is inserted into the inner channel 130 the spacing between the pins may then be decreased. Finally, the pins may be removed from the inner channel 130. This step of deforming or expanding the end 108 of the elongated tube 102 can be accomplished pneumatically or by any other suitable machine.

It should be understood that many variations of this example method are contemplated by the present disclosure. For example, the insert 132 may be coated with an adhesive, which bonds the insert 132 to the inner channel 130 of the elongated tube 102 once the adhesive cures. Still further, the components of the example exercise handle 100 may be constructed so as to facilitate the assembly process. For instance, in examples where the gasket 106 is symmetric and has two rims 180, the gasket 106 may be formed of a material than can be deformed or press-fitted into a final shape during the assembly process (e.g., the rims 180 may be formed during a final assembly process). This characteristic would allow the grommet 146 and the holes 144 in the ends 140, 142 of the strap 138 to be disposed about the gasket 106 during assembly and retained on the gasket 106 thereafter. As a further example, the gasket 106 may be formed of two pieces so that the grommet 146 and the holes 144 in the ends 140, 142 of the strap 138 can be disposed about the gasket 106 during assembly. The two pieces may then be permanently engaged to one another.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

We claim:

1. An exercise apparatus comprising:

an elongated tube having an inner channel and at least one end;

a handle including a strap, wherein a hole is defined in the strap, the hole for receiving the elongated tube;

a grommet disposed at the hole in the strap;

a gasket having a hole that receives the elongated tube, wherein the grommet is disposed about the gasket such that relative movement between the grommet and the gasket is substantially prevented when the elongated tube moves within the hole of the gasket; and an insert that is arranged in the inner channel of the elongated tube near the at least one end, wherein the insert does not occupy part of the hole of the gasket and cannot pass through the hole in the gasket, and wherein the gasket has at least one rim that restricts movement of the gasket relative to the grommet when the elongated tube moves within the hole of the gasket.

2. An exercise apparatus as recited in claim 1, wherein the grommet is at least coated with a rubberized or polymeric material.

3. An exercise apparatus as recited in claim 1, wherein the gasket has two rims that restrict movement of the gasket relative to the grommet when the elongated tube moves within the hole of the gasket.

4. An exercise apparatus as recited in claim 3, wherein the two rims of the gasket have diameters that are unequal.

5. An exercise apparatus as recited in claim 3, wherein the handle further comprises a handle grip disposed on the strap, wherein the hole in the strap extends through two overlapping ends of the strap, the grommet securing the two overlapping ends of the strap at the hole.

6. An exercise apparatus as recited in claim 3, wherein the insert has a cross-section that is larger than a diameter of the inner channel in a neutral state, the elongated tube being deformed to place the insert within the inner channel of the elongated tube.

7. An exercise apparatus as recited in claim 3, wherein the handle further comprises a first loop and a second loop formed by the strap, wherein a hand grip is disposed on the strap forming the first loop, wherein the second loop is disposed about the at least one end of the elongated tube, the second loop cooperating with the at least one end of the elongated tube to reduce movement between the gasket and the grommet.

8. An exercise apparatus as recited in claim 7, wherein a diameter of the hole of the gasket is constant along a length of the gasket.

9. An exercise apparatus for resistance training, the exercise apparatus comprising:

an elongated tube having an inner channel and at least one open end;

a handle including a strap, wherein a hole is formed through overlapping ends of the strap;

a grommet disposed at the hole in the strap of the handle, the grommet securing the overlapping ends of the strap to one another;

a gasket having a hole that receives the elongated tube near the at least one open end and at least one rim that restricts movement of the gasket relative to the grommet, wherein the grommet is disposed about the gasket; and an insert that is arranged in the inner channel of the elongated tube near the at least one end, wherein a segment of the elongated tube disposed about the insert is positioned adjacent to the gasket, wherein the insert has a larger cross section than the hole in the gasket, wherein the insert does not occupy the hole of the gasket, and wherein at least the gasket and the insert operate to prevent the handle from separating from the elongated tube.

10. An exercise apparatus as recited in claim 9, wherein the grommet has two rims that restrict movement of the grommet in at least two directions.

11. An exercise apparatus as recited in claim 9, wherein the grommet is formed of or at least coated with a rubberized or polymeric material.

12. An exercise apparatus as recited in claim 9, wherein the gasket has two rims, at least one of which is disposed near a middle of the gasket.

13. An exercise apparatus as recited in claim 9, wherein the handle further comprises a first loop and a second loop formed by the strap, wherein a hand grip is disposed on the strap forming the first loop, wherein the second loop is disposed about the at least one end of the elongated tube, the second loop cooperating with the at least one end of the elongated tube to reduce movement between the grommet and the gasket.

14. An exercise apparatus as recited in claim 13, wherein the insert has a cross-section that is larger than a diameter of the inner channel in a neutral state, the elongated tube being deformed to place the insert within the inner channel of the elongated tube.

15. An exercise apparatus as recited in claim 13, further comprising a second handle, a second grommet, a second gasket, and a second insert disposed near a second open end of the elongated tube.

16. A method for assembling an exercise apparatus having an elongated tube and a handle disposed near an end of the elongated tube, the method comprising:

joining two ends of a strap in an overlapping arrangement;

forming a hole in the two ends of the strap at the overlapping arrangement;

securing a grommet to the hole in the two ends of the strap, the grommet securing the two ends of the strap to one another;

arranging the grommet about a gasket, the gasket having at least one rim that restricts movement of the gasket relative to the grommet;

inserting the end of the elongated tube through a hole in the gasket;

expanding a segment of the elongated tube near the end of the elongated tube; and placing an insert within the elongated tube.

17. A method of assembling the exercise apparatus as recited in claim 16, wherein the step of placing the insert within the elongated tube further comprises arranging the insert adjacent to the gasket.

18. A method of assembling the exercise apparatus as recited in claim 16, further comprising a step of forming a first loop and a second loop from the strap, wherein at least one of the first and second loops cooperates with the end of the elongated tube to prevent the grommet from moving along the gasket.

* * * * *